US006092519A

United States Patent [19]

Fish et al.

[11] Patent Number: 6,092,519

[45] Date of Patent: Jul. 25, 2000

[54] HEATED SAMPLE CONTAINER CASE AND METHOD

[75] Inventors: David J. Fish, Missouri City; Brian H. Welker, Sugar Land, both of Tex.

[73] Assignee: Welker Engineering Company, Sugar Land, Tex.

[21] Appl. No.: 09/266,669

[22] Filed: Mar. 11, 1999

[51] Int. Cl.[7] ..... F24J 1/00

[52] U.S. Cl. ..... 126/263.01; 126/263.02

[58] Field of Search ..... 126/263.01, 263.02, 126/263.03, 204, 206, 207, 246, 261

[56] References Cited

U.S. PATENT DOCUMENTS

| | | | |
|---|---|---|---|
| 2,733,710 | 2/1956 | Zibell | 126/263.01 |
| 5,042,455 | 8/1991 | Yue et al. | 126/263.02 |
| 5,137,011 | 8/1992 | Roth | 126/263.01 |
| 5,460,160 | 10/1995 | Parrott | 126/263.01 |

FOREIGN PATENT DOCUMENTS

| | | | |
|---|---|---|---|
| 736030 | 11/1932 | France | 126/263.02 |

*Primary Examiner*—James C. Yeung
*Attorney, Agent, or Firm*—Herzog, Crebs & McGhee, LLP

[57] ABSTRACT

A case for heating sample containers during transport, where the case has a housing that containing thermal insulation and a disposable heating material that generates heat by chemical reaction with oxygen. Closeable apertures allow control over the access of oxygen to the heating material, and thereby over the rate of reaction. A method of portably heating a sample cylinder is also disclosed.

6 Claims, 1 Drawing Sheet

HEATED SAMPLE CONTAINER CASE AND METHOD

BACKGROUND OF THE INVENTION

1. Field of the Invention

The present invention relates to sample warming techniques and devices, and more particularly, to a sample warming device and method useful in transporting samples from natural gas pipelines and the like.

2. Description of the Related Art

Natural gas flowing through pipelines often needs to be sampled to determine its average heat of combustion, and therefore its value as fuel. To take these samples technicians must often drive to remote locations with the sample cylinder exposed to the elements. This results in the sample cylinders equilibrating to ambient temperature, which in winter can easily be below 30° F. Taking a sample under these conditions exposes natural gas from an underground pipeline at approximately 60° F. to a temperature below the boiling point of some components of the sample at the pressure of the pipeline. As a consequence, some components of the natural gas condense to a liquid in the sample cylinder, skewing the composition of the gas phase. Analysis of the head space then fails to give an accurate analysis of the natural gas sample unless the sample cylinder is warmed enough to vaporize any liquefied components, a time-consuming task ill-suited to the analytical laboratory.

Previous attempts to solve this problem in the laboratory (is this correct?) have entailed heating sample cylinders by electrical means. This solution impractical during sample cylinder transport to and from remote field sites, where electricity is unavailable. Heating under these conditions would necessitate wiring trucks especially for this purpose, and would also involve a power drain on the battery whenever the engine is shut off. Consequently electrical heating is unsatisfactory as a solution to this problem.

Thus a need exists for a means of warming sample cylinders during transport to and from remote sites without use of electricity.

SUMMARY OF THE INVENTION

The present invention addresses these needs through providing a case having a housing with thermal insulation and a disposable heating material disposed around the sample cylinder, where those heating materials comprise an oxidizable compound that generates heat on chemical reaction with oxygen. Closeable apertures on the housing permit control of the access of oxygen to the oxidizable compound, and thereby allow control of the rate of the oxidation reaction.

It is thus an object of the present invention to provide a means of warming a sample cylinder during their transport under cold conditions.

It is also an object of the present invention to provide a means of heating a sample cylinder without use of electricity.

It is further an objection of the present invention to provide a means of controlling the rate of heating, and in particular of ceasing heating when it is no longer necessary.

BRIEF DESCRIPTION OF THE DRAWINGS

The invention will be better understood by reference to the exemplary embodiment shown in the drawing below, wherein.

Figure 1:
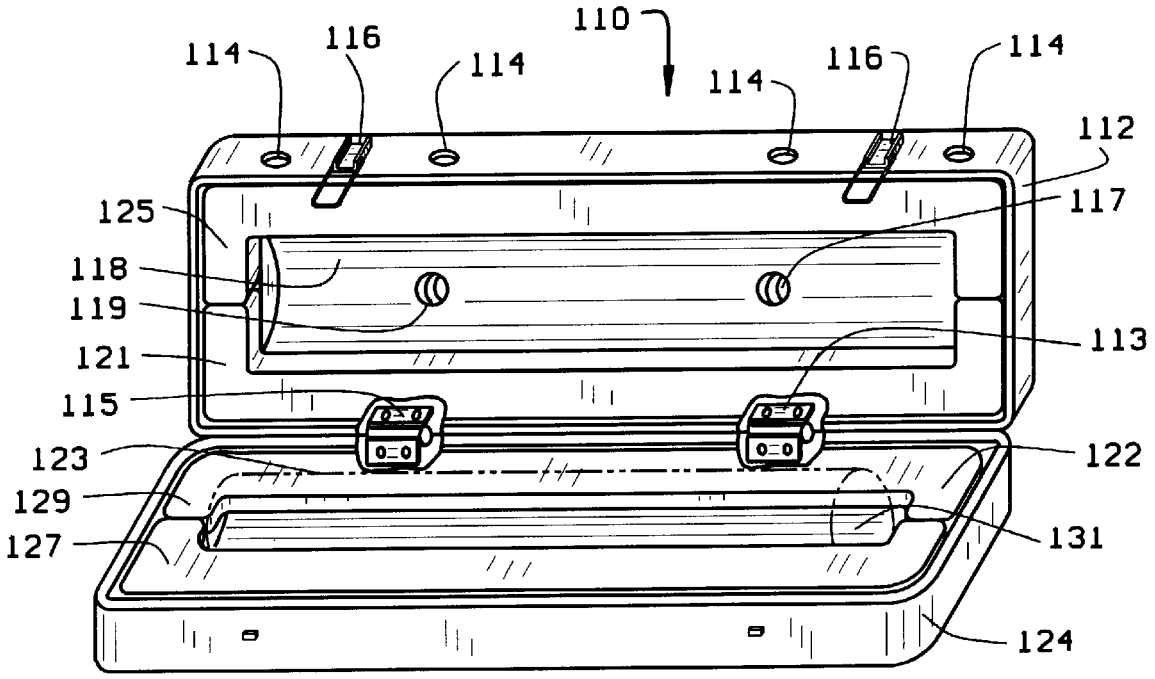
FIG. 1 is a top right front perspective view of the heated sample container case with the lid open, showing where the sample container rests.

It is to be noted, however, that the appended drawings illustrate only a typical embodiment of the invention, currently the best mode known to the inventor. The drawings are not intended to be the only possible embodiment, but rather are provided to comply with the statutory requirement for a Drawing of the invention and to comply with the statutory requirement for disclosure to the best mode known to the inventor of making the invention. The Drawing is to only be considered as an example of the types of heated sample cases that can be used and does not limit the scope of the claimed invention, for the claimed invention may admit to other equally effective embodiments. Further, all functional equivalents are intended to be included within the scope of the invention, not merely structural equivalents since the invention relates to a broad new method approach to portably heating a sample cylinder. Likewise, this examples that follow merely demonstrate the operability of the invention for its stated purpose, and are not the only possible constructions. On the contrary, there are many other constructions that might the possible within the scope of the claims. Ordinary artisans will understand this and will know that the invention is in the unique approach to the problem rather than in the specific hardware we choose to accomplish the solution to the problem.

DETAILED DESCRIPTION OF THE INVENTION

A detailed description will now be given to the invention with reference to the Drawing. Again is noted that this is merely an exemplary Drawing and therefore an exemplary detailed description. With that in mind, and first referring to FIG. 1, heated sample container case 110 comprises an lid 112 connected to a body 124 by two hinges 113,115 or any other fastening devices. For example, if the case 110 was made of plastic, the hinges 113,115 could simply be conventional plastic hinges formed integrally with the remainder of the case. Lid 112 has one or more entry apertures 114, one or more exit apertures 117,119, one or more latches 116 for fastening the lid to body 124, thermal insulation 118, two heat packs 121,125 and two slide closure 201,203 (seen in FIG. 2). Heat packs 121 and 125, that together formed the heating medium 122, could be eliminated if heat packs in the lower body 124 were sufficient to provide a desired amount of heat.

Body 124 also has thermal insulation 131, on top of which is placed disposable heating material 122, which in use comprises two heat packs 127,129. Heat packs 127,129 surround the sides of the sample container 123, with 1 heat pack disposed alongside of and around a portion of each end of the sample container 123.

The body, lid, insulation, and apertures can be of any desired shape consistent with performing their intended functions and consistent with holding a cylinder of any desired shape. The case can be either tailored to a particular cylinder or can be more universal in application.

Figure 2:
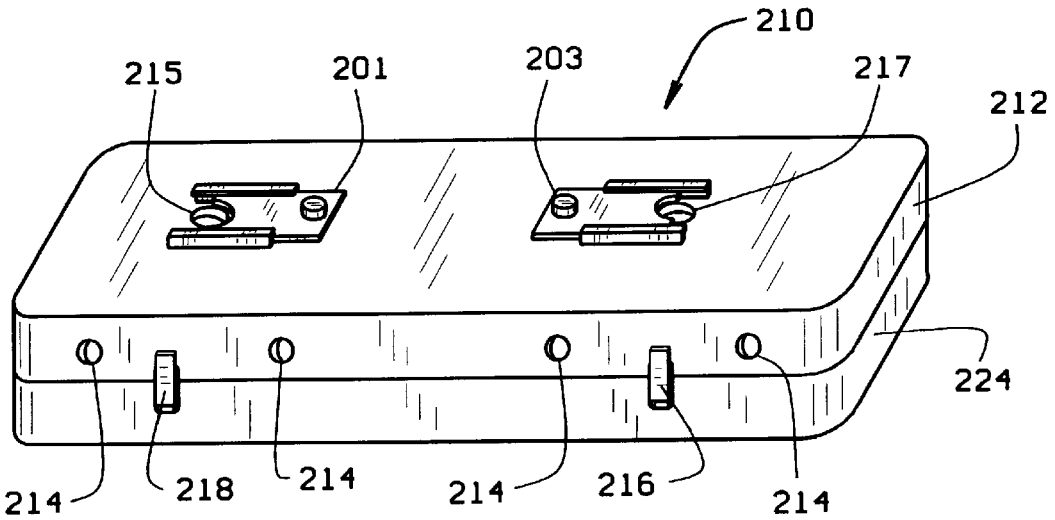
FIG. 2 is a top right front perspective view of the heated sample container case with the lid closed, showing the apertures for access of oxygen to the interior of the case.

Referring next to FIG. 2, latches 214,216 on heated sample container case 210 fasten lid 212 to body 224. It will be understood that body to can, lead to 12 and body 224 can be identical to case 110, lid 112 and body 124 of FIG. 1. However, they are given different numbers here to emphasize the fact that the case can be of alternate construction. For purposes of example and discussion, case 210 is made of a hard plastic or wood, while case 110 is made of metal such as lightweight aluminum. Apertures to 114 allow entry of oxygen and apertures 215,217 allow the escape of any waste gases or excess heat at an adjustable rate which can be preselected by a movement of to slide closures 201,203 based on conditions of use and experience. It will be understood that apertures 214 can also be provided with slide closures 201,203 to better seal the interior of the container when the latch is to 16,218 are closed. Closing of apertures 214,215,217 by suitable slide closures such as slide closures 201,203 substantially restricts access of oxygen to the disposable heating material. This minimizes the heating of the interior of the case 210 because the heat packs 127,129,121,125, which generate heat through chemical reaction between an oxidizable compound and atmospheric oxygen, are prevented from obtaining sufficient oxygen to react at their maximum rate to generate heat. Accordingly, full or partial closing of apertures 214,215,217 impedes the heat-producing reaction, and thereby allows the operator to slow or stop the reaction when less heat is desired or heat is no longer required and to thereby save the remainder of the disposable heating material for later use.

It is apparent that the sample container case could be constructed from a variety of materials such as metals, plastics, wood, or composites consistent with the objects of the invention, and could have a variety of dimensions. It is further apparent that the thermal insulation could also be composed of a variety of materials commonly used for this purpose, such as polymer foams. It is also apparent that the precise placement of apertures and means of fastening the lid to the body are not critical to operation of the heated sample container case, and that a wide range of possible arrangements are contemplated within the scope of the present invention.

Similarly, it is apparent that a number of different disposable heating materials could be used to warm the sample container through a chemical reaction. In a preferred embodiment, the disposable heating material consists of an oxidizable compound that generates heat on aerial oxidation. In a more preferred embodiment, the disposable heating material consists of a high-surface area form, such as a powder, of an elemental metal. In a highly preferred embodiment, the disposable heating material consists of finely divided iron powder, as is found in commercially available HEAT PAKS™ (Heat Max, Inc., Dalton, Ga.).

In operation, a cylinder is placed within the heating material within the insulated case and the apertures are set at a desired opening. This provides a desired amount of heat to the sample cylinder to keep it reasonably warm until it is placed in operation. Likewise, the cylinder may be similarly placed and heated during its return from the sampling location to prevent the sample taken from being chilled prior to reaching a laboratory for analysis.

EXAMPLES

Example 1

Two identical sample cylinder cases 32" long×5" deep×7" wide having a case volume of 1120 cubic inches were tested. Each case was adapted to contain one of two identical sample cylinders 2" diameter×15" long cylinder having a cylinder volume of 500 cc's, supported and insulated by thermal insulating pillows 2.5" deep×7" wide×30" long (2 pieces, one per half of case) within the case. One case (the chemically heated one) was provided with 8 pounds of a chemical heating medium in heat packs and the other left without as a control. The heat packs were such as are commercially available from Heatmax, Inc., PO Box 1191, Dalton, Ga. 30721. The two cases with and without the chemical heating medium were placed in a room at 75 F. The control case returned to room temperature within 45 minutes, while the heated case stayed above 100 F. for over 8 hours.

Example 2.

The two cylinders in cases as in Example 1 are each placed in a refrigerated environment of about 32 F. for sufficient time for the control sample to equilibrate with the refrigerated environment. The chemically heated case maintains a temperature of over 100 F. while the control equilibrates to 32 F. The cylinders are then filled with a sample of 300 cc of pipeline natural gas at 110 F. and the sample cylinders are kept in their respective heated and unheated cases in the ambient (32 F.) environment. After 45 minutes, when the control case is found to have equilibrated to the temperature of the ambient environment, the two sample cylinders are examined. The control case's sample cylinder has a visible amount condensate (which appears to be about 4–5 cc) whereas the chemically heated case's sample cylinder has no visible condensate.

While the present invention has been described for use in warming containers of samples from natural gas pipelines, it is apparent that it could equally well be used to warm a wide variety of other samples where warming is desired without use of electricity. For example, the present invention could be used to warm containers of food, drink, or medical supplies in remote locations, or to thaw frozen valves or pipes. All such applications are contemplated within the scope of the present invention.

Accordingly, it is also apparent from the foregoing that the present invention is not limited to the embodiments shown. Other equally effective embodiments are contemplated and within the scope of the present invention.

What is claimed is:

1. A case for an elongate sample cylinder with removable disposable air activated heat packs comprising:

an elongate hollow shell defined by an elongate lid and an elongate body;

thermal insulation sized and arranged to fit in the lid and the body of said shell, said insulation defining an elongate inner compartment sized and arranged to receive the elongate sample cylinder and the removable heat packs;

at least one hinge pivotally connecting the lid to the body so the lid can be opened and closed to allow access to the inner compartment;

at least one latch to secure the lid to the body; and a plurality of apertures in said shell axially aligned with a plurality of apertures in said insulation allowing air to move in and out from ambient atmosphere through said shell and said insulation to said inner compartment to actuate the heat packs.

2. The apparatus of claim 1 further including at least one slide closure mounted on said shell over one of said apertures to adjustably control the size of the aperture exposed to ambient atmosphere, to adjustably control the movement of air to and from said inner compartment to regulate the temperature of the heat packs.

3. The apparatus of claim 1 wherein the sample cylinder contains samples from a natural gas pipeline.

4. A method of heating an elongate sample cylinder in a case with disposable air activated heat packs, comprising the steps of:

providing a case for accepting the sample cylinder, the case including:

i. an elongate hollow shell defined an elongate lid and an elongate body;

ii. thermal insulation sized and arranged to fit in the lid and the body of said shell, said insulation defining an elongate inner compartment sized and arranged to receive the elongate sample cylinder and the removable heat packs;

iii. at least one hinge, pivotally connecting the lid to the body so the lid can be opened and closed to allow access to the inner compartment;

iv. at least one latch to secure the lid to the body;

v. a plurality of apertures in said shell axially aligned with a plurality of apertures in said insulation, allowing air to move in and out from ambient atmosphere through said shell and said insulation to said inner compartment to actuate said heating packs;

placing at least one disposable heat pack in said inner compartment; and inserting a sample cylinder in said inner compartment.

5. The method of claim 4 wherein the case further includes at least one side closure mounted on said shell over one of said apertures to adjustably control the size of the aperture exposed to ambient atmosphere, to adjustably the movement of air to from said inner compartment, to regulate the temperature of the heat packs.

6. The method of claim 4 wherein the sample cylinder contains samples from a natural gas pipeline.

* * * * *